United States Patent [19]

Gardner

[11] 3,945,058

[45] Mar. 23, 1976

[54] COLLAPSIBLE SAUNA BATH KIT

[76] Inventor: Kent A. Gardner, 210 S. Glenn Drive, Yakima, Wash. 98902

[22] Filed: Dec. 17, 1974

[21] Appl. No.: 533,718

[52] U.S. Cl. ..... 4/163
[51] Int. Cl.[2] ..... A61H 33/06
[58] Field of Search ..... 4/160, 163, 164; 128/367, 128/368

[56] References Cited

UNITED STATES PATENTS

| | | | |
|---|---|---|---|
| 1,531,833 | 3/1925 | Bauer | 4/163 |
| 1,533,174 | 4/1925 | Erdosy | 4/163 |
| 2,551,552 | 5/1951 | Wahl | 4/164 |
| 2,864,097 | 12/1958 | Schoneberg | 4/160 |
| 3,092,843 | 6/1963 | Wright | 4/164 |

*Primary Examiner*—Richard E. Aegerter
*Assistant Examiner*—Charles E. Phillips
*Attorney, Agent, or Firm*—Dana E. Keech

[57] ABSTRACT

A kit collapsible readily to be confined neatly in a foldable two-part travelling case embodied with the kit and to provide, when extended, a sauna bath apparatus embracing a water-tight, water-collecting base receptacle, a porous, plastic web covered cot overlying and supported by said receptacle, a tent overlying and enclosing said cot and extending downwardly between said cot and said receptacle, a foldable cushioned head stool being included in said kit and located at one end of said tent opposite a hole in an end wall of the latter to facilitate the patron reclining on said cot with his head extending through said hole and resting on said cushioned stool. Plural electric steamers deposited in said receptacle are controllable by the patron to furnish a desired degree of heat and humidity to the interior of the tent. A double tab zipper is available for actuation by the patron to open a slit in the tent wall to facilitate access to said cot, said zipper also being operable after the parton has entered the tent to close said slit from a position within the tent, in preparing for taking a sauna bath therein, and for opening said slit when said bath is concluded for the patron to readily emerge from the tent.

2 Claims, 8 Drawing Figures

COLLAPSIBLE SAUNA BATH KIT

SUMMARY OF INVENTION

Portable apparatus for giving sauna baths has, in the past, been provided in various forms.

A primary object of the present invention is to provide such an apparatus or kit which is light in weight and is readily collapsible and embodies a two-part travelling case into which the balance of the kit fits, when folded, so as to be confined therewithin when said case is closed, and in which said case, when opened, provides a water-tight receptacle co-extensive horizontally with the expanded kit and underlying the latter to confine condensed moisture released as steam vapor in the operation of the kit.

Another object of the invention is to provide such a kit including a cot and overlying tent supported within and extending upward from said opened case, in which said cot and tent are substantially co-extensive in length with said opened case, said kit including a head support outside one end of said tent, the latter having a hole through which the head of a patron may extend while lying on said cot to rest his head on said support.

A further object of the invention is to provide such a kit having a slit providing entry for a patron to the interior of said tent which slit is closeable by a zipper accessible for manual closing by the patron from inside said tent.

A still further object of the invention is to provide such a kit equipped with one or more electric water vaporizers resting within said opened case and controllable by the patron from within said tent for varying the temperature produced therein by said vaporizers.

A yet further object is to provide such a kit wherein the cover of the cot thereof is formed of a foraminous plastic sheet for supporting the body of the patron in a reclining position and allowing water vapor to circulate through the interstices of said cot cover, for applying said vapor directly to the patron's body and allowing perspiration from the body and condensed vapor to gravitate through said cot cover into said opened case.

Still another object of the invention is to provide such a kit in which the hinge uniting the two halves of the travelling case comprising the base of the sauna apparatus when opened, is shielded to prevent water leaking through the hinge.

DETAILED DESCRIPTION OF THE PREFERRED EMBODIMENT

Figure 1:
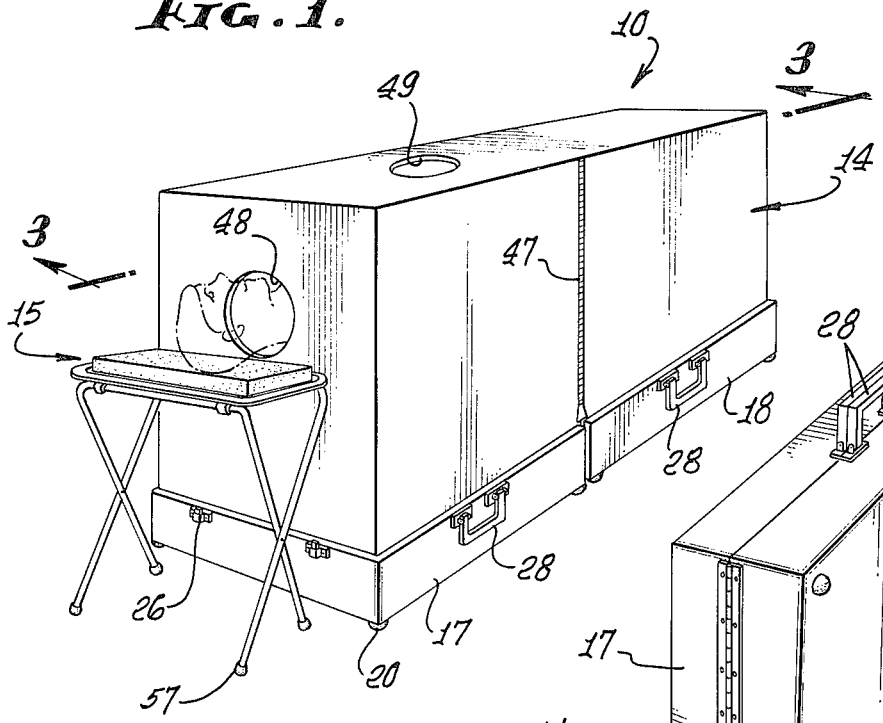
FIG. 1 is a diagrammatic perspective view of the invention being used by a patron in taking a sauna bath.

The invention is shown in the drawings as embodied in a collapsible sauna bath kit 10 which embraces a foldable two part travelling case 11, a foldable cot 12, a foldable tent frame 13, a tent 14, a foldable head supporting stool 15 and a pair of automatic hot steam vaporizers 16.

The travelling case 11 comprises two half parts 17 and 18 which are substantially identical in construction and are molded of plastic or fiberglass in the form of two shallow water tight, water collecting rectangular trays which are joined together along conjunctive edges by a hinge 19 and are provided on their bottoms in the four corner portions of each with resilient rubber protectors 20. Overlying hinge 19 so as to prevent moisture leaking downwardly between the half parts 17 and 18 is a plastic vinyl strip 25, opposite edges of which are cemented to said parts. The outer ends of case parts 17 and 18 which come together when said case is closed are provided with luggage studs 26 and clasps 27 which are readily united for closing the case 11 when the two halves thereof are brought together as shown in FIG. 2.

Figure 2:
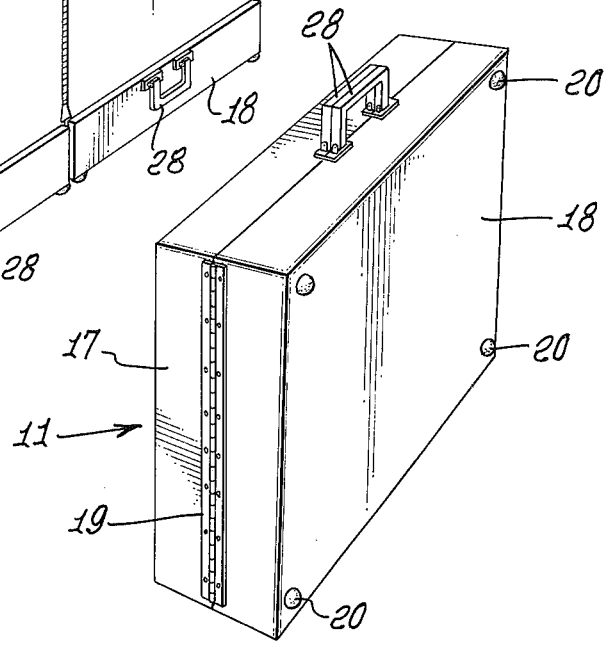
FIG. 2 is a diagrammatic perspective view of the invention completely collapsed and confined within the foldable travelling case which is shown as closed after the balance of the kit has been folded and stored within the two halves of said case.

A pair of handles 28 are mounted on the case half parts 17 and 18 adjacent the vertical axis of the center of gravity of the kit when the latter is entirely confined within the closed case 11 as shown in FIG. 2, to serve for handling the kit just like a piece of luggage.

Figure 3:
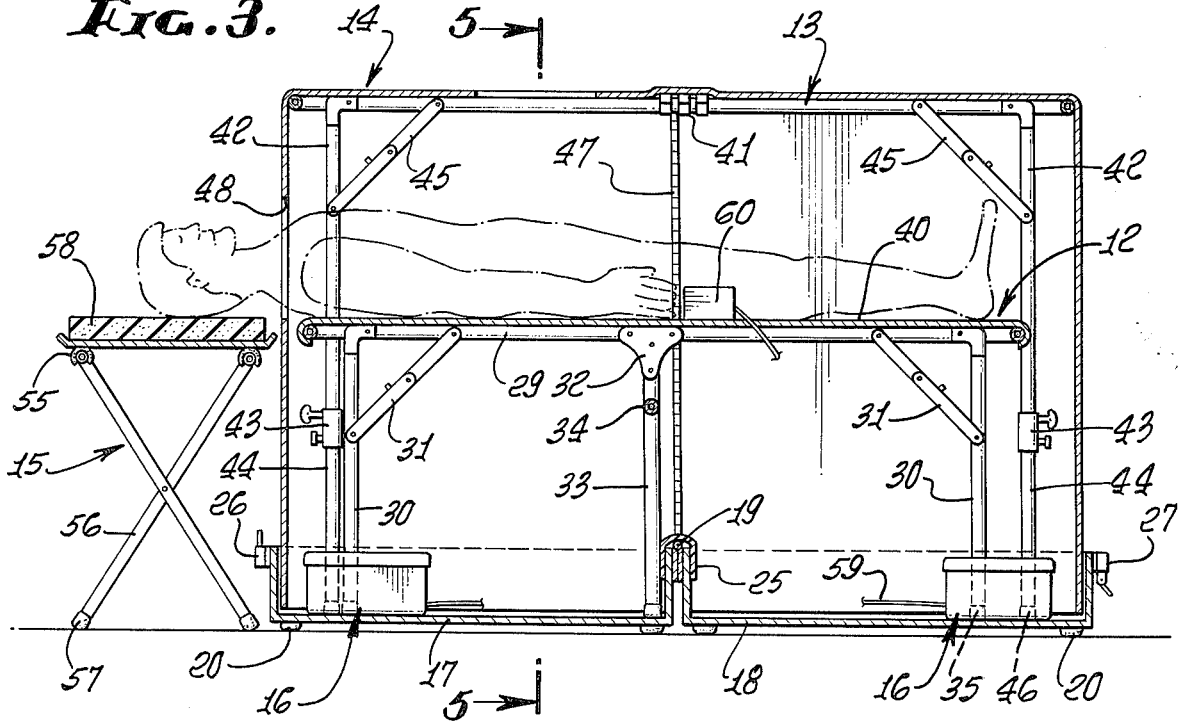
FIG. 3 is a longitudinal sectional view taken on the line 3—3 of FIG. 1.
Figure 8:
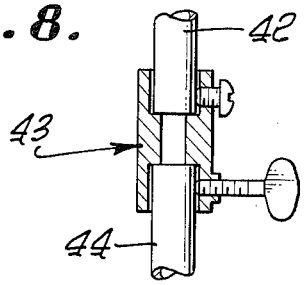
FIG. 8 is an enlarged vertical sectional view illustrating one of the four vertical set and wing screw couplings employed for extending the legs of the tent frame so as to give said tent adequate height above the cot and yet permit the tent frame to be folded as shown in FIG. 4 to fit within one of the two half parts of the travelling case of the kit.
Figure 5:
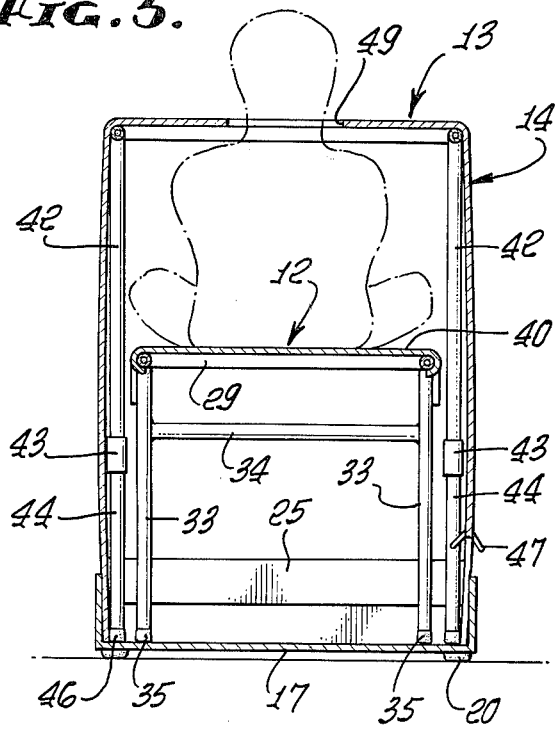
FIG. 5 is a transverse sectional view taken on the line 5—5 of FIG. 3. This figure shows both inside and outside zipper tabs for controlling the opening or closing of a vertical slit formed in the tent side wall of the kit so that this zipper may be controlled by the patron while he is getting into the sauna apparatus of the kit as well as after he has assumed a reclined position on the cot of the kit inside the apparatus and is ready to commence a sauna bath.
Figure 7:
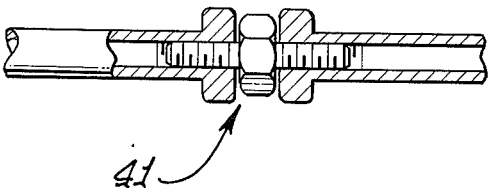
FIG. 7 is an enlarged detailed sectional view illustrating one of two horizontal screw friction split couplings used in joining opposite end portions of the tent frame of the invention.
Figure 6:
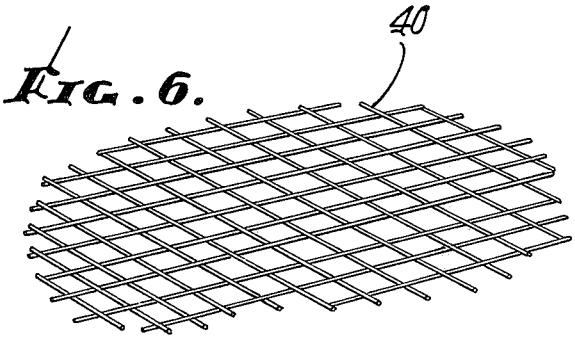
FIG. 6 is an enlarged detailed perspective view realistically showing the foraminous character of the net plastic cot cover.
Figure 6:
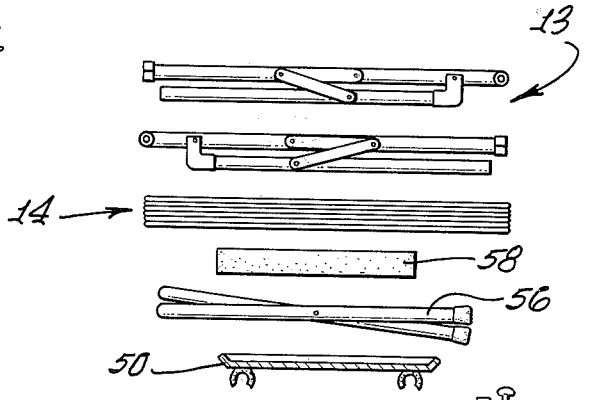
Figure 4:
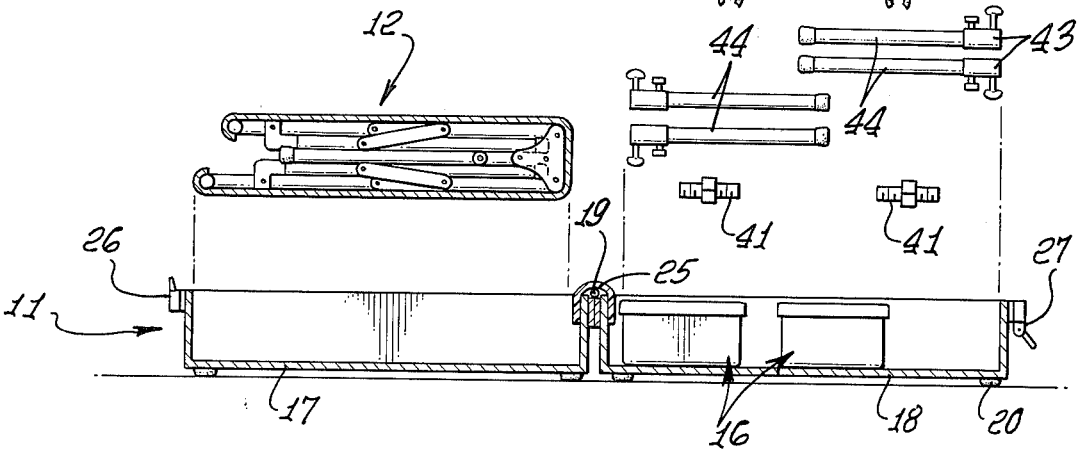
FIG. 4 is a view similar to FIG. 3 and is taken on the same plane thereof excepting that in this figure the parts in the kit of the invention, other than the foldable travelling case, are shown in exploded relation with the interiors of the two half parts of said case and with said other parts of the kit folded so that they will all fit snugly within and be confined in said two half parts of the travelling case when these kit elements are advanced towards said case along the broken lines indicated in this figure.

The foldable cot 12 is clearly illustrated in longitudinal and transverse sections thereof shown in FIGS. 3 and 5 and in the longitudinal sectional view of this when closed as shown in FIG. 4. This cot is slightly shorter than a conventional camp cot as it is only employed in the bath kit 10 for supporting the body of the patron from his shoulders to his feet. It is also designed so that when it is opened to have this length it can be folded up to fit neatly downwardly within the tray 17 of the case 11. When opened, as shown in FIG. 3, the foldable cot 12 provides a horizontal rectangle frame 29, slightly rounded at the corners, which is preferably formed of one-half inch metal tubing having pairs of legs 30 pivotally mounted on opposite end portions of cot frame 29 and normally held in rigid rectangular relationship with said frame by spring toggle braces 31. The frame 29 is divided centrally and pivotally connected to opposite ends of T-heads 32 which are fixed on upper ends of a pair of middle cot legs 33 joined by a cross bar 34. The lower ends of all the cot legs 30 and 33 are provided with rubber cushioning crutch tips 35.

Covering the rectangular cot frame 29 and wrapped therearound and secured thereto as by screws or cement is a sheet of poly-vinyl plastic mesh material 40 of a foraminous character for allowing hot air and moisture to pass therethrough. This material provides a comfortable surface for the patron occupying the bath kit 10 to lie down upon while taking a bath and admits heat and moisture into direct contact with his skin while he is reclining on said cot.

As may readily be seen by reference to FIGS. 3 and 5, the cot 12 fits readily within the two trays 17 and 18 when the case 11 comprising said halves is opened for setting up the apparatus 10 of the sauna bath kit for use.

The foldable tent frame 13 of the kit 10 is rectangular with rounded corners and preferably made of the same tubing from which the cot frame is made, this frame being united centrally by a pair of horizontal compression couplings 41 which fill gaps between opposite end portions of tent frame 13 and unite said portions when the kit is set up for use as shown in FIGS. 3 and 5. The foldable tent frame 13 is also provided with pairs of legs 42 which are connected by screw-wing nut couplings 43 to lower extensions 44 to give said legs the desired height to provide the head room desired between the frame 13 and the cot 12 for accommodating the body of the patron.

It is also to be noted that when the apparatus of the kit is set up for use as shown in FIGS. 3 and 5, the tent frame legs 42 extend downwardly within the up turned opened trays 17 and 18 of the kit travelling case 11. The legs 42 when thus extended are retained in normal relation with the tent frame 13 by pairs of toggle braces 45. The bottom ends of the extended legs of the foldable tent frame 13 are provided with rubber crutch tips 46.

The tent 14 is preferably formed of light plastic vinyl printed with a decorative colored pattern, this tent being shaped to loosely fit over the tent frame 13 as shown in FIGS. 3 and 5 so that the bottom edge of the tent may be readily tucked inside of the upwardly opened trays 17 and 18 of the foldable travelling case 11 of the kit. Suitable short slits are formed upwardly in the bottom side edges of the tent 14 so as to fit downwardly over the hinged edges of the two trays 17 and 18 and thus prevent undue bunching of the tent at these middle points in the lower edge thereof. In one side of the tent 14 the upper end of one of the short slits above referred to is lengthened vertically to the top of the tent and a double tab controlled zipper 47 is mounted in said slit extension.

Provided in one end of the tent 14 just above the level of the cot cover 40 is a hole 48 through which a patron using the apparatus provided by the kit 10 may extend his head and neck outwardly through said tent wall while reclining at full length on the cot 12. Another similar hole 49 is provided in the top of tent 14 to facilitate the patron assuming a sitting position in which he will thus be able to extend his head and neck upwardly through hole 49 while sitting on the cot 12.

The foldable head supporting stool 15 of the kit 10 includes a light metal tray 50 having fastened thereon four rubber clasps 55 which can be readily engaged by or disengaged from a pair of U-shaped tubular leg structures 56 which are centrally pivoted together and provided at their lower ends with rubber crutch tips 57. The tray 50 supports a solid styrofoam cushion 58 on the same level as the cot cover 40 when the stool 15 is rested on the floor just outside the hole 48 formed in one end of the tent 14. (See FIGS. 1 and 3). The stool 15 is thus in a perfect position to comfortably support the head of the patron when he has taken a reclining position on the cot 12 with his head and neck extending outwardly through the hole 48.

The pair of automatic hot steam vaporizers 16 may be energized through an electric cord 59 leading to a domestic electrical service outlet and includes a manually operated switch 60 which is arranged conveniently to be reached by the hand of the patron making use of the invention for controlling the operation of the vaporizer 16 during the bath. It is also to be noted that when the patron is reclining on the cot 12 in preparation for or during the taking of a sauna bath his hand may readily engage the inside one of the zipper tabs on double zipper 47 so as to either zip or unzip this zipper. Thus, he may zip this zipper after he has entered the tent 14 and may unzip the same before he leaves.

I claim:

1. A collapsible sauna bath kit comprising:

a foldable travelling case made in two half parts comprising water-tight, water-collecting rectangular trays, a conjunctive pair of edges of said parts being hingedly joined and covered with a water-tight seal, said half parts, when opened, lying outwardly flat against the floor, facing upwardly in tandem relation;

a foldable cot which, when folded, fits downward neatly into one of said open case half parts to be entirely confined therein and which when opened, provides a horizontal body-supporting covered-frame approximately co-extensive lengthwise with and spaced upwardly from and in parallelism with said opened travelling case, and suitable pairs of legs extending downward from said cot frame into both said half parts of said opened case;

a foldable tent frame which, when folded, fits downwardly neatly into the other of said open case half parts to be entirely confined therein, and which when opened, provides a horizontal tent cover supporting frame approximately co-extensive lengthwise with said opened travelling case, and having suitable pairs of legs extending downwardly from said tent frame outside of said cot frame and into both said half parts of said opened case;

a tent overlying said tent frame and having side and end walls hanging downward outside of said legs and inside of the side and end walls of said case half parts;

there being an opening in one of the tent end walls through which a patron may extend his head and neck while reclining on said cot;

foldable means for supporting the patron's head while extended through said opening; and means for introducing water vapor into said tent to produce a sauna bath for said patron, there being also space available in said case half parts for confining therein said tent, when folded, said head support means, when folded, and said vapor introducing means.

2. A collapsible sauna bath kit as defined in claim 1 wherein said means for supporting the patron's head comprises a collapsible stool provided with a cushion for directly contacting the head of the patron, the legs of said stool being foldable whereby the entire stool when folded will fit into space remaining unused by other elements of said kit in one of said two half parts of said travelling case.

* * * * *